United States Patent [19]

Bainbridge et al.

[11] Patent Number: 4,632,410

[45] Date of Patent: Dec. 30, 1986

[54] COMBINATION TOOL CADDY AND STOOL

[75] Inventors: John F. Bainbridge, P.O. Box 45, Marcellus, Mich. 49607; James R. Bainbridge, Cass County, Mich.

[73] Assignee: John F. Bainbridge, Marcellus, Mich.

[21] Appl. No.: 739,172

[22] Filed: May 30, 1985

[51] Int. Cl.[4] ..... B25H 5/00

[52] U.S. Cl. ..... 280/32.5; 297/124; 297/135; 297/172; 297/353

[58] Field of Search ..... 280/32.5, 32.6, 47.34, 280/47.35, 79.1 R, 79.1 A; 297/124, 353, 135, 172

[56] References Cited

U.S. PATENT DOCUMENTS

| | | | |
|---|---|---|---|
| 1,143,443 | 6/1915 | Schramm | 312/246 |
| 1,290,072 | 1/1919 | Bullock | 108/27 |
| 1,428,743 | 8/1923 | Grover | 324/127 |
| 1,603,212 | 11/1924 | Raymond | 297/140 |
| 1,609,609 | 2/1926 | Dahl | 280/202 |
| 1,888,478 | 5/1931 | Steidl | 108/136 |
| 2,448,300 | 12/1947 | Eaddy | 280/34 |
| 2,678,684 | 10/1954 | Thomson | 297/204 |
| 2,701,168 | 11/1955 | Schemers | 304/9 |
| 2,725,783 | 12/1955 | Jackson | 88/16 |
| 2,818,266 | 1/1957 | Cabler | 280/32.5 |
| 2,819,938 | 8/1957 | Zerver | 312/201 |
| 2,872,252 | 2/1959 | Konkle | 304/2 |
| 2,872,966 | 2/1959 | Chamness | 297/345 |
| 2,894,561 | 7/1959 | MacKintosh | 297/172 |
| 3,089,438 | 10/1961 | Paradise | 108/26 |
| 3,326,553 | 1/1965 | Forrest | 273/55 |
| 3,669,392 | 6/1972 | Saunders | 248/121 |
| 3,677,569 | 7/1972 | Larson | 280/32.6 |
| 3,712,667 | 1/1973 | Weber | 297/140 |
| 3,908,565 | 9/1975 | Burnett | 108/147 |
| 3,976,155 | 8/1976 | Esch | 280/32.5 |
| 4,085,686 | 4/1978 | Turner et al. | 108/25 |
| 4,119,044 | 10/1978 | Hines | 108/27 |
| 4,122,956 | 10/1978 | Hargrove | 211/131 |
| 4,249,749 | 2/1981 | Collier | 280/35 |
| 4,287,835 | 9/1981 | Stratton | 108/26 |
| 4,333,682 | 6/1982 | Iser | 297/192 |
| 4,373,761 | 2/1983 | Hansberry, Jr. | 312/250 |
| 4,397,374 | 8/1983 | Rumage et al. | 182/129 |
| 4,542,909 | 9/1985 | Littwin et al. | 280/79.1 A |

*Primary Examiner*—John A. Pekar

*Attorney, Agent, or Firm*—Price, Heneveld, Cooper, DeWitt & Litton

[57] ABSTRACT

A combination tool caddy and stool comprises a base, having a pedestal-type seat mounted on a central portion of the base. A vertical support post is mounted on a marginal portion of the base in a laterally spaced apart relationship with the seat. A tray is supported on the vertical post in a horizontal orientation by an adjustable coupling which permits the tray to be moved vertically and horizontally to a location that is conveniently reachable by a user seated on the seat. The tray can also be mounted on the support post in a vertical orientation to form a backrest for the seat. The seat and the tray are preferably attached to the base by interchangeable coupling members, so that the seat can be removed, and the tray supported on the center of the base to provide additional stability. Wheels may be provided on the base so that the unit can be manually propelled by a seated user from one work site to another.

48 Claims, 10 Drawing Figures

COMBINATION TOOL CADDY AND STOOL

BACKGROUND OF THE INVENTION

The present invention relates to tool carts and the like, and in particular to a combination tool caddy and stool.

Various types of tool carts are available for use by mechanics to position tools, repair parts, instruments and the like adjacent to the work site. Normally, such carts have casters or wheels, as shown in U.S. Pat. No. 4,119,044 to Hines to facilitate transporting the cart from one location to another.

However, such prior devices do not provide a comfortable seat with a tray that can be adjusted to a location within easy reach of a user seated on the seat. Also, such prior devices are not generally adaptable into a wide variety of configurations to accommodate different types of jobs and situations.

SUMMARY OF THE INVENTION

One aspect of the present invention is to provide a combination tool caddy and stool having a base, with a pedestal seat attached to a central portion of the base. A support post is attached to a marginal portion of the base, in a laterally spaced apart relationship with the seat. A tray is also provided for supporting articles thereon, and includes an adjustable coupling which permits the tray to be moved vertically and horizontally to a location that is conveniently reachable by a user seated on the seat to facilitate placing and removing articles from the tray.

Another aspect of the present invention is to provide a combination tool caddy and stool having a base with a pedestal seat attached to a central portion thereof. A support post is attached to a marginal portion of the base, in a laterally spaced apart relationship with the seat. A rigid plate is provided, and includes a first coupling which releasably mounts the plate on the support post in a generally horizontal orientation to form a tray on which articles can be supported, and a second coupling which releasably mounts the plate on the support post in a generally vertical orientation to form a backrest for the seat.

Yet another aspect of the present invention is a combination tool caddy and stool having a base with a first coupling member upstanding from a central portion of the base, and a second coupling member upstanding from a marginal portion of the base in a laterally spaced apart relationship with the first coupling member. A pedestal seat is provided with a third coupling member shaped to mate with the first coupling member to releasably and selectively support the seat on the central portion of the base at a predetermined position above the base. A vertical support post is also provided with a tray attached to the upper end thereof, and a fourth coupling member connected with the lower end thereof. The fourth coupling is shaped to mate with the second coupling member to releasably and selectively support the tray on the marginal portion of the base at a predetermined position above the base. The fourth coupling member also mates with the first coupling member, such that when the seat is removed from the base, the tray can be supported from the central portion of the base to provide additional stability.

Yet another aspect of the present invention is to provide a combination tool caddy and stool, having a base with a pedestal seat attached to a central portion of the base. A vertical support post is provided with a tray attached to the upper end thereof, and the lower end connected with and upstanding from a marginal portion of the base, to support the tray on the base at a predetermined position above the base. A plurality of ground engaging wheels are connected with the base, and are positioned to support the combination tool caddy and stool on a suitable work surface, whereby a user seated on the seat can manually propel or scoot the unit between various work sites.

The principal objects of the present invention are to provide a combination tool caddy and stool, which is capable of greatly increasing the efficiency and level of comfort involved in performing a wide variety of mechanic-type tasks, and other similar jobs. The unit is mobile, and is adapted to be interconnected into several different configurations to accommodate many types of different tasks and situations. The unit provides both a tool tray and a stool which are mutually adjustable in a fashion to greatly reduce strain on the worker. The unit is very stable, and hence safe for use in many different environments. The combination tool caddy and stool is quite efficient in use, economical to manufacture, capable of a long operating life, and particularly well adapted for the proposed use.

These and other features, advantages and objects of the present invention will be further understood and appreciated by those skilled in the art by reference to the following written specification, claims and appended drawings.

FIG. 9 is a perspective view of the unit, illustrating yet another configuration of the present invention, wherein the tray is lowered and the handle is attached to the base to facilitate moving the unit under low objects, such as vehicles and the like.

DETAILED DESCRIPTION OF THE PREFERRED EMBODIMENTS

Figure 1:
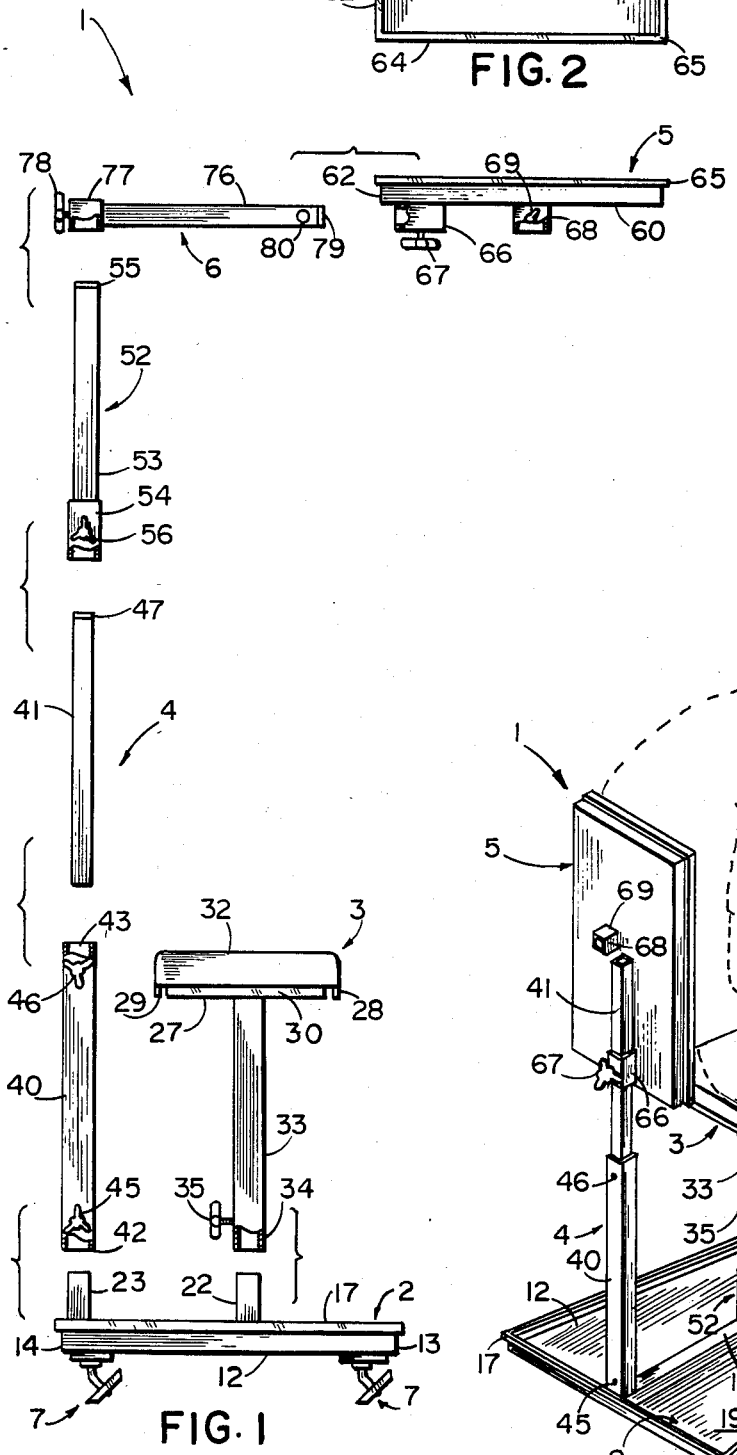
FIG. 1 is an exploded view of a combination tool caddy and stool embodying the present invention, shown in one of a variety of different possible configurations.

For purposes of description herein, the terms "upper," "lower," "right," "left," "rear," "front," "vertical," "horizontal," and derivatives thereof shall relate to the invention as oriented in FIG. 1. However, it is to be understood that the overall invention, as well as its individual parts, may assume various alternative orientations, except where expressly specified to the contrary.

Figure 5:
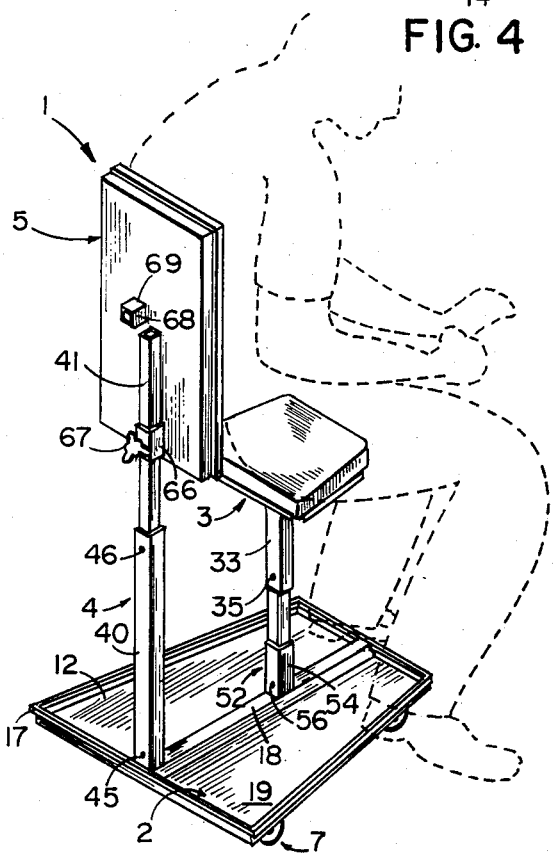
FIG. 5 is a generally rearward perspective view of the unit, shown in another configuration of the present invention, wherein the tray is positioned vertically to form a backrest for the seat.
Figure 7:
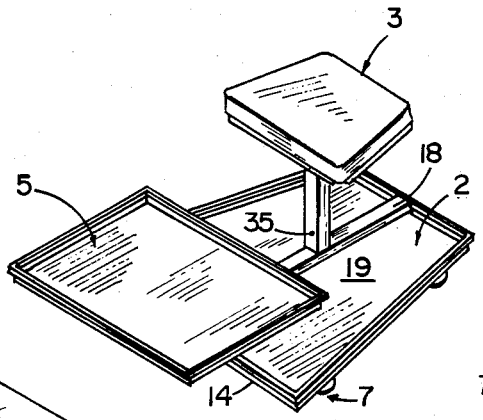
FIG. 7 is a perspective view of the unit, illustrating yet another configuration of the present invention, wherein the tray is shown in a lowermost position.
Figure 8:
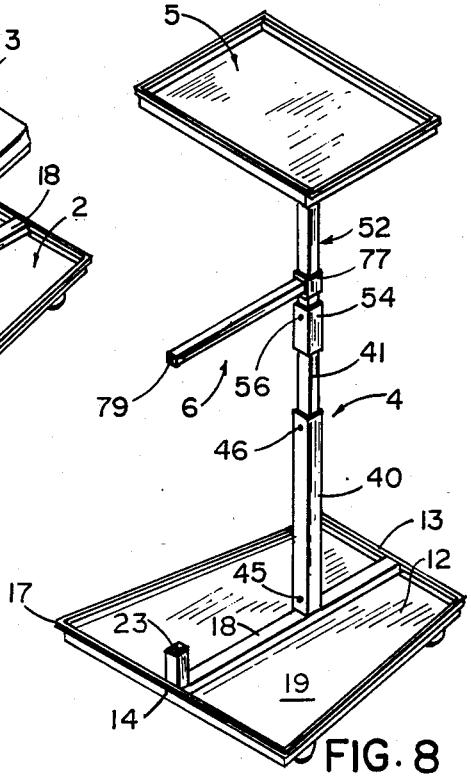
FIG. 8 is a perspective view of the unit, illustrating yet another configuration of the present invention, wherein the tray is supported from a central portion of the base, and a handle is provided to facilitate transport.

The reference numeral 1 (FIG. 1) collectively designates a combination tool caddy and stool unit embodying the present invention. The unit 1 includes a base 2, and a pedestal seat 3 mounted to a central portion of base 2. A support post 4 is mounted on a marginal portion of base 2, and extends generally vertically in a laterally spaced apart relationship with seat 3. A tray 5 is provided to retain articles such as tools, repair parts, instruments, etc. thereon. An arm 6 attaches tray 5 to vertical post 4 to support the same in a generally horizontal orientation. Tray 5 is adjustable both vertically and horizontally to a location that is conveniently reachable by the user seated on seat 3, such as the configurations shown in FIGS. 7 and 10. Tray 5 can also be mounted on vertical post 4 in a vertical orientation to form a backrest for seat 3, as illustrated in FIG. 5. Seat 3 and tray 5 are preferably attached to base 2 by interchangeable couplings, so that seat 3 can be removed from base 2, and tray 5 supported from the center of base 2 to provide additional stability, as illustrated in FIG. 8. Wheels 7 may be provided on base 2, so that the unit 1 can be manually propelled or scooted by a seated user.

Figure 3:
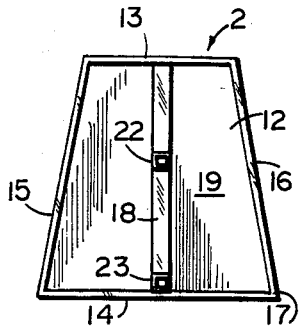
FIG. 3 is a top plan view of a base portion of the unit.
Figure 10:
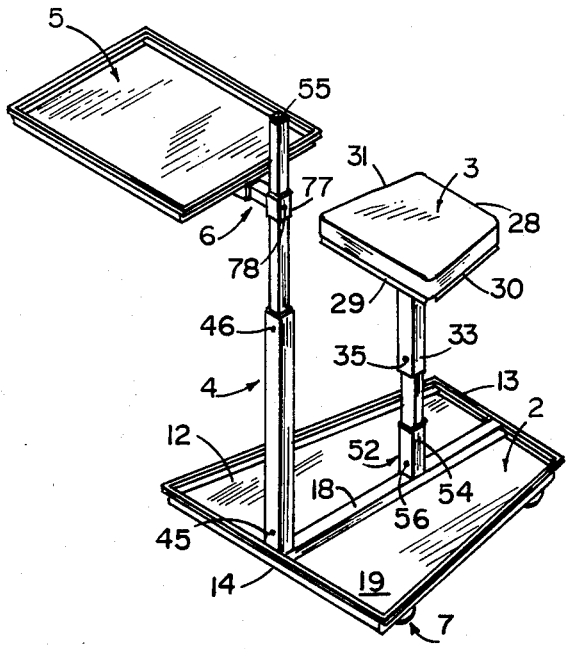
FIG. 10 is a perspective view of the unit, illustrating yet another configuration of the present invention, wherein the seat is shown in an elevated position, with the tray oriented to the side of the seat.

Base 2 (FIGS. 3 and 4) has a generally trapezoidal plan shape, comprising a base plate 12 with sidewalls 13–16 upstanding from the marginal edge thereof. A split molding sleeve 17 covers the upper edges of sidewalls 13–16. A rectangular channel 18 is attached to base plate 12 along the longitudinal centerline thereof, and extends between the forward and rearward sidewalls 13 and 14 to define a reinforcing beam for base 2. The base sidewalls 13–16 in conjunction with base plate 12 define a lower tray 19 into which various articles may be retained, as discussed in greater detail below. Base 2 also forms a footrest for the seated user, particularly when seat 3 is in an elevated position, as shown in FIGS. 5 and 10.

Two coupling members 22 and 23 (FIG. 1) are attached to and extend upwardly from reinforcing beam 18, and are adapted to releasably connect seat 3 and vertical post 4 with base 2. In the illustrated example, coupling members 22 and 23 comprise rigid studs, in the form of square, hollow, channel sections, having their lower ends rigidly attached to reinforcing beam 18 by means such as welding, or the like. Stud 22 is located on reinforcing beam 18 at a location substantially commensurate with the geometric center of base plate 12. Stud 23 is attached to reinforcing beam 18 immediately adjacent the wider, rearward sidewall 14.

Figure 4:
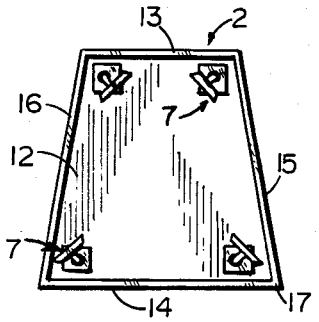
FIG. 4 is a bottom plan view of said base.

As best illustrated in FIG. 4, one of the wheels 7 is attached to each of the four corners of base plate 12 on the bottom side thereof. In the illustrated example, wheels 7 comprise swivel casters which permit the unit 1 to be propelled in all different directions. Base 2 preferably has a relatively small overall height, in the nature of 6–8 inches This low profile enables at least a portion of base 2 to be positioned under low objects, such as vehicles and the like, for applications to be discussed below.

Seat 3 comprises a rigid plate 27, having a generally trapezoidal plan configuration which permits the feet of a seated user to rest comfortably on the floor of the work area, yet achieve maximum stability and versitility. The illustrated plate 27 includes downwardly bent sidewalls 28–31, which depend from the marginal edge of plate 27. A padded cushion 32 is attached to the upper surface of plate 27, and has a shape substantially commensurate therewith. Seat 3 also includes an elongated, rigid pedestal 33, having its upper end fixedly attached to the lower surface of plate 27, at a central portion thereof. The illustrated pedestal 33 comprises a section of square tubing, which has an open end that defines a second coupling member 34. The interior of second coupling member 34 is shaped to closely receive therein center stud 22. A lock bolt or set screw 35 is threadedly mounted in the lower end of pedestal 33, and is adapted to abuttingly engage coupling stud 22 to interconnect seat 3 with base 2 in the configuration illustrated in FIG. 1. In the illustrated seat 3, pedestal 33 has a length which positions cushion 32 approximately 14–18 inches above the surface of the floor. Seat 3 may be positioned in any one of the four possible horizontal orientations on center coupling stud 22. However, it is generally preferred that the wider rear side 29 of seat 3 be positioned toward the wider, rear side 14 of base 2, as illustrated in FIGS. 1, 5, 6, 7 and 10.

The illustrated vertical support post 4 comprises first and second members 40 and 41, which are telescopingly interconnected. Lower post 40 comprises a section of square, hollow tubing having an open, lower end 42 and an open, upper end 43. The open, lower end 42 of post 40 defines a fourth coupling member in which outer coupling stud 23 is closely received in the configuration illustrated in FIG. 1. A lock bolt or set screw 45 is threadedly mounted in the lower end of post 40, and is adapted to abuttingly engage coupling stud 23 to interconnect the same in the configuration shown in FIG. 1. The upper end 43 of post 40 is also open, and includes a lock bolt or set screw 46 threadedly mounted therein to engage the exterior surface of post 41. It is to be noted that lower post 40 is symmetrical, such that its ends 42 and 43 can be oriented either upwardly or downwardly.

Upper support post 41 has a square transverse cross-sectional shape, which is adapted to be closely received within the interior of lower post 40, in a telescoping fashion. Preferably, upper support post 41 is hollow to reduce weight and cost, and includes at least one end cap 47 to close off the upper end thereof. Both upper support post 41 and lower support post 40 are preferably sized to have a length which is slightly less than the length of base tray 19, so that they can be stored therein during shipping and non-use configurations.

An extension post 52 is also provided for purposes to be described in greater detail hereinafter. Extention post 52 is an elongated, rigid structure, including a square channel section 53, and a mating collar 54 at the lower end of channel 53. Channel 53 has a shape substantially identical with upper support post 41, and also includes an upper end cap 55. Collar 54 comprises a short section of square channel which is substantially identical to the channel of lower support post 40, and is fixedly attached to the lower end of channel section 53, by means such as welding or the like. A lock bolt or set screw 56 is threadably mounted in collar 54, and is adapted to releasably connect extension post 52 with other portions of the unit, as described below. Extension 52 also preferably has a length that is slightly less than the length of base tray 19, so that it can be stored therein when not in use, along with support posts 40 and 41.

Figure 2:
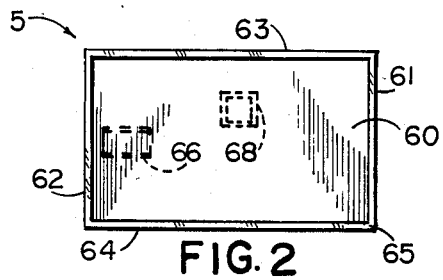
FIG. 2 is a top plan view of a tray portion of the unit.

Tray 5 (FIGS. 1 and 2) is adapted to support a wide variety of articles thereon such as tools, instruments, repair parts, and the like, and includes a base plate 60 having a substantially rectangular plan shape, with sidewalls 61–64 upstanding from a marginal edge thereof. A split molding sleeve 65 extends around and covers the upper edges of tray sidewalls 61–64. A collar 66 is attached to the lower surface of base plate 60, adjacent the forward sidewall 62. Collar 66 comprises a section of square tubing, with a lock bolt or set screw 67 threadably mounted in the lower sidewall thereof. Collar 66 has an interior socket or aperture with a longitudinal centerline oriented in a substantially parallel relationship with base plate 60. A second collar 68 is fixedly attached to the bottom surface of base plate 60 adjacent a center portion thereof. Collar 68 is oriented generally vertically, and has a lock bolt or set screw 69 threadably mounted in a sidewall thereof oriented toward sidewall 64 of tray 5. As best illustrated in FIG. 2, collar 68 is located adjacent to the longitudinal center of tray 5, and is laterally offset slightly from the transverse center of tray 5 by an amount sufficient to avoid interference with arm 5.

The illustrated support arm 6 (FIG. 1) comprises an elongated, rigid channel section 76, having a square transverse cross-sectional shape. A collar 77 is attached to one end of channel section 76, and is oriented substantially perpendicular to the longitudinal axis thereof. A lock bolt or set screw 78 is threadably mounted in the end wall of collar 77 oriented opposite to channel section 76. An end cap 79 is mounted on the opposite end of channel section 76. A through pin 80 is detachably mounted in the outer end of arm 6, and includes outwardly protruding ends which abut collar 66 to prevent tray 5 from inadvertently coming off of arm 6. Pin 80 can be removed from arm 6, so as to permit tray 6 to be bodily removed from arm 6 for independently transporting tray 6 between various work sites, without moving base 2.

As illustrated in the enclosed drawings, base 2, seat 3, vertical support post 4, tray 5, arm 6 and extension post 52 can be interconnected in a wide variety of configurations to accommodate different tasks and environments. In general, coupling studs 22 and 23, and mating sockets 34, 42, 56, 68 and 77 have a geometrically similar nonshape which provide a secure pivotal connection between base 2 and the remaining parts of unit 1. Lock bolts 35, 45, 46, 56, 67 and 78 serve to longitudinally interconnect the various interchangeable parts of unit 1.

Figure 6:
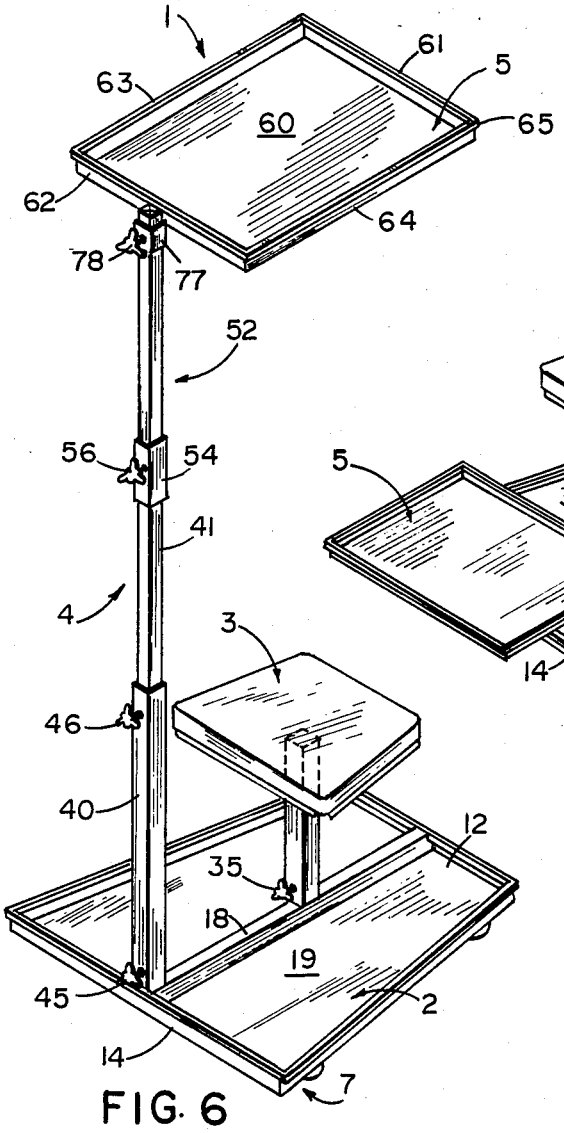
FIG. 6 is a perspective view of the unit, illustrating yet another configuration of the present invention, wherein the tray is shown in an elevated position.

When seat 3 is assembled on unit 1, it must be supported on center coupling stud 22 to insure proper stability. Seat 3 may be attached directly to center stud 22 as shown in FIGS. 6 and 7. Alternatively, seat 3 may be raised to an elevated position, as shown in FIGS. 5 and 10, by the use of extension post 52 in the following fashion. The lower collar 54 on extension post 52 is inserted onto center coupling stud 22, and is locked thereon by tightening lock bolt 56. The lower end of seat pedestal 33 is then inserted over the upper end of extension post 52, such that seat 3 is vertically adjustable thereon. The selected position of seat 3 is maintained by tightening lock bolt 35. Seat 3 is preferably never raised to an elevation at which the user's feet do not touch the floor of the work area. Hence, it is contemplated that support post 4 would not be used to support seat 3, and that seat 3 would never be supported at such an elevation which might result in instability. With seat 3 adjusted to a proper, stable height, as shown in FIGS. 1, 5, 6, 7 and 10, a user seated on seat 3 may readily propel or scoot unit 1 around the floor of the work area, thereby providing improved worker efficiency and alleviating worker strain.

Tray 5 is supported in the elevated, cantilevered fashion shown in FIGS. 6 and 10 by connecting the lower end of support post 40 with outer coupling stud 23. Lock bolt 45 is tightened to secure the connection. Upper support post 41 is inserted into, the upper end of lower support post 40, and lock bolt 46 is tightened to maintain posts 40 and 41 at their selected height. The collar 77 on support arm 6 is then inserted over the upper end of upper support post 41. Since the illustrated embodiment of the present invention employs square shaped channels, arm 4 can be positioned on upper support post 41 in any one of four different horizontal orientations. However, to insure proper stability, the present invention contemplates that arm 3 should not be connected with upper support post 41 in a manner that will cause the end of arm 6 to extend out over the rearward edge 14 of base 2 when arm 6 is used to support tray 5. The present invention does contemplate that arm 6 may be oriented in any one of the remaining three horizontal positions when arm 6 is used to support tray 5. Arm 3 is vertically adjustable on upper support post 41, and is releasably attached thereto by tightening lock bolt 78.

Tray 5 is attached to arm 6 by inserting collar 77 over arm channel section 76, thereby supporting tray 5 on base 2 in a cantilevered fashion. Tray 5 can be extended outwardly and retracted inwardly with respect to support post 4, so as to achieve proper positioning for the specific task and situation. Tray 5 is releasably attached to arm 6 by tightening lock bolt 78. With tray 5 in the elevated and cantilevered position illustrated in FIGS. 1 and 6, unit 1 can be adapted for vehicle engine repair by simply removing seat 3 from center coupling stud 22. Base 2 can then slide underneath the vehicle, so as to position tray 5 at a convenient location directly above the engine compartment of the vehicle.

The vertical position of tray 5 can be raised by use of extension post 52, as shown in the configuration illustrated in FIGS. 1 and 6. In the subject configuration, the collar 54 of extension post 52 is inserted over the upper end of upper support post 41, and lock bolt 56 is tightened to securely interconnect the two parts. The collar 77 of arm 6 is then inserted over the upper end of extension post 52, and lock bolt 78 is tightened to lock the arm and the attached tray 5 securely in place.

Tray 5 may be attached directly to vertical support post 4, as shown in the configuration illustrated in FIG. 8. In this configuration of the present invention, collar 68 is inserted over the upper end of extension post 52, or the upper end of support post 41, when extension post 52 is not being used. Lock bolt 69 is then tightened to secure tray 5. In this configuration, vertical support post 4, along with tray 5, may be attached to the center coupling stud 23 to achieve additional stability. Furthermore, arm 6 may be mounted on either the upper end of extension post 52 (FIG. 8), or upper support post 41, and oriented to serve as a handle to facilitate transporting unit 1 from one location to another. When arm 6 is used as a handle, it can be oriented in any one of the four horizontal positions possible. The elevated tray configurations illustrated in FIGS. 6 and 8 are particularly adapted for working on overhead tasks, such as a vehicle raised on a rack, or the like.

Figure 9:
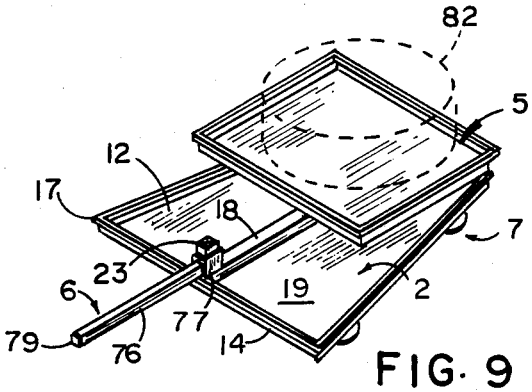

Tray 5 may be attached directly to either the center coupling stud 22 or the outer coupling stud 23, as illustrated in FIGS. 9 and 7 respectively. In such configurations, collar 68 on the lower side of tray 5 is simply inserted over one of the studs 22 and 23, and lock bolt 69 may be tightened for additional security, although such lock nut tightening is not normally necessary in these configurations. In these configurations, arm 6 may be attached to tray collar 66 to form a handle to facilitate transporting unit 1 to and between various work sites. In the configuration shown in FIG. 9, arm 6 is attached directly to the outer coupling stud 23, and is oriented in a direction which is diametrically opposite reinforcing beam 18, so as to form a handle for a low profile configuration of unit 1. This configuration of unit 1 is particularly adapted for operations underneath a vehicle, such as supporting a pan 82 for changing the motor oil, and other similar operations.

It is to be understood that FIGS. 1 and 5–10 are merely exemplary of six different configurations which the present invention may assume. Other configurations of unit 1 are also contemplated by the present invention. For example, extension 52 may be connected with either center coupling stud 22 or outer coupling stud 23 to support tray 5 either directly from collar 68 or cantilevered on arm 5.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiment of the invention in which an exclusive property or privilege is claimed are defined as follows:

1. A combination tool caddy and stool, comprising:

a base adapted to be supported on a generally horizontal work surface, and including a central portion thereof and a marginal portion thereof disposed outwardly of said central portion;

a seat having a normally horizontally oriented upper surface shaped to support a seated user thereon, and a pedestal including an upper end thereof connected with said seat, and a lower end thereof connected with and upstanding from the central portion of said base to support said seat on said base at a predetermined position above said base;

a tray having a normally horizontally oriented upper surface shaped to support articles thereon;

a support, comprising a vertically oriented, rigid post having a lower end thereof connected with and upstanding from the marginal portion of said base;

means for adjustably mounting said tray on said support, comprising:

a rigid support arm having first and second ends;

means for connecting the second end of said tray support arm with said vertical post to support said tray in a cantilevered fashion from said vertical post;

means for releasably connecting said tray with said tray support arm, whereby said tray can be bodily detached from said tray support arm and independently transported to various work sites; and wherein said tray support arm is adapted for grasping to form a handle to facilitate transporting said base between various work sites.

2. A combination tool caddy and stool as set forth in claim 1, wherein:

said adjustable tray mounting means includes a collar connected with the second end of said tray support arm and shaped to closely receive said vertical post therein; and means for releasably connecting said collar with said vertical post at selected locations therealong, whereby said tray can be supported at a location that is conveniently reachable by a user seated on said seat to facilitate placing and removing articles from said tray.

3. A combination tool caddy and stool as set forth in claim 2, wherein:

said means for connecting said tray to said tray support arm comprises a second collar connected with said tray, and shaped to closely receive said tray support arm therein in a normally generally horizontal orientation; said second collar including means for releasably connecting the same with said tray support arm at selected locations therealong.

4. A combination tool caddy and stool as set forth in claim 3, wherein:

said second collar is shaped to closely receive said vertical post therein, whereby said tray can be mounted on said vertical post to form a backrest for said seat.

5. A combination tool caddy and stool as set forth in claim 4, including:

a plurality of ground engaging wheels connected with said base and positioned to support said combination tool caddy and stool on the work surface, whereby a user seated on said seat can manually propel said combination tool caddy and stool between various work sites.

6. A combination tool caddy and stool as set forth in claim 5, wherein:

said base includes a first coupling member attached to the central portion of said base; and said seat pedestal includes a second coupling member attached to the lower end thereof, and shaped to mate with said first coupling member to releasably and selectively connect said seat with said base.

7. A combination tool caddy and stool as set forth in claim 6, wherein:

said base includes a third coupling member attached to the marginal portion of said base; and said vertical support post includes a fourth coupling member attached to the lower end thereof, and shaped to mate with said third coupling member to releasably and selectively connect said vertical support post with said base.

8. A combination tool caddy and stool as set forth in claim 7, wherein:

said fourth coupling member also mates with said first coupling member, whereby when said seat is removed from said base, said tray can be supported from the central portion of said base to provide additional stability.

9. A combination tool caddy and stool as set forth in claim 8, wherein:

said tray includes a third collar connected therewith; said third collar being shaped to closely receive an upper end of said vertical support post therein, and having a longitudinal axis normally oriented in a generally vertical orientation, whereby said tray can be supported directly on the upper end of said vertical support post.

10. A combination tool caddy and stool as set forth in claim 9, wherein:

said vertical support post comprises first and second telescoping members, with means for releasably interconnecting said telescoping members to facilitate varying the height of said tray.

11. A combination tool caddy and stool as set forth in claim 10, including:

an extension post having a lower end thereof shaped for releasable attachment to the upper end of said vertical support post, and an upper end thereof shaped for close reception in said tray support arm collar to facilitate supporting said tray in an elevated position.

12. A combination tool caddy and stool as set forth in claim 11, wherein:

said extension post lower end is shaped to mate with said first coupling member, and said extension post upper end is shaped to mate with said second coupling member to facilitate supporting said seat in an elevated position.

13. A combination tool caddy and stool as set forth in claim 12, wherein:

said base includes a lip upstanding along a marginal edge of said base to define another tray, adapted to receive articles therein, and disposed normally below said first-named tray.

14. A combination tool caddy and stool as set forth in claim 13, wherein:

said tray arm collar is shaped to mate with said third coupling member to provide a low profile handle for said base.

15. A combination tool caddy and stool as set forth in claim 14, wherein:

said base has a generally trapezoidal plan shape with four corners at each of which one of said wheels is mounted.

16. A combination tool caddy and stool as set forth in claim 15, wherein:

said first and third coupling members each comprise a stud upstanding from said base; and said second and fourth coupling members each comprise a socket shaped to closely receive one of said studs therein.

17. A combination tool caddy and stool as set forth in claim 16, wherein:

said studs and said sockets have a geometrically similar, non-circular, transverse cross-sectional shape.

18. A combination tool caddy and stool as set forth in claim 17, wherein:

said third tray collar is shaped to mate with said third coupling member.

19. A combination tool caddy and stool as set forth in claim 1, including:

a plurality of ground engaging wheels connected with said base and positioned to support said combination tool caddy and stool on the work surface, whereby a user seated on said seat can manually propel said combination tool caddy and stool between various work sites.

20. A combination tool caddy and stool as set forth in claim 1, wherein:

said base includes a first coupling member attached to the central portion of said base; and said seat pedestal includes a second coupling member attached to the lower end thereof, and shaped to mate with said first coupling member to releasably and selectively connect said seat with said base.

21. A combination tool caddy and stool as set forth in claim 20, wherein:

said base includes a third coupling member attached to the marginal portion of said base; and said vertical support post includes a fourth coupling member attached to the lower end thereof, and shaped to mate with said third coupling member to releasably and selectively connect said vertical support post with said base.

22. A combination tool caddy and stool as set forth in claim 21, wherein:

said fourth coupling member also mates with said first coupling member, whereby when said seat is removed from said base, said tray can be supported from the central portion of said base to provide additional stability.

23. A combination tool caddy and stool as set forth in claim 1, wherein:

said tray includes a collar connected therewith; shaped to closely receive an upper end of said vertical support post therein, and having a longitudinal axis normally oriented in a generally vertical orientation, whereby said tray can be supported directly on the upper end of said vertical support post.

24. A combination tool caddy and stool as set forth in claim 1, wherein:

said vertical support post comprises first and second telescoping members, with means for releasably interconnecting said telescoping members to facilitate varying the height of said tray.

25. A combination tool caddy and stool as set forth in claim 1, including:

an extension post having a lower end thereof shaped for releasably attachment to the upper end of said vertical support post, and an upper end thereof adapted for operable connection with said tray to facilitate supporting said tray in an elevated position.

26. A combination tool caddy and stool as set forth in claim 1, wherein:

said base has a generally trapezoidal plan shape with four corners at each of which one of said wheels is mounted.

a seat having a normally horizontally oriented upper surface shaped to support a seated user thereon, and a pedestal including an upper end thereof connected with said seat, and a lower end thereof connected with and upstanding from the central portion of said base to support said seat on said base at a predetermined position above said base;

a rigid plate;

a support post having a lower end thereof connected with and upstanding from the marginal portion of said base in a generally vertical orientation;

means for releasably mounting said plate on said support post in a generally horizontal orientation to form a tray for supporting articles at a location adjacent to said seat; and means for releasably mounting said plate on said support post in a generally vertical orientation to form a backrest for said seat.

27. A combination tool caddy and stool, comprising:

a base adapted to be supported on a generally horizontal work surface, and including a central portion thereof and a marginal portion thereof disposed outwardly of said central portion;

a seat having a normally oriented upper surface shaped to support a seated user thereon, and a pedestal including an upper end thereof connected with said seat, and a lower end thereof connected with and upstanding from the central portion of said base to support said seat on said base at a predetermined position above said base;

a rigid plate;

a support post having a lower end thereof connected with and upstanding from the marginal portion of said base in a generally vertical orientation;

means for releasably mounting said plate on said support post in a generally horizontal orientation to form a tray for supporting articles at a location adjacent to said seat; and means for releasably mounting said plate on said support post in a generally vertical orientation to form a backrest for said seat.

28. A combination tool caddy and stool as set forth in claim 27, including:

a plurality of ground engaging wheels connected with said base and positioned to support said combination tool caddy and stool on the work surface, whereby a user seated on said seat can manually propel said combination tool caddy and stool between various work sites.

29. A combination tool caddy and stool as set forth in claim 28, wherein said vertical mounting means for said plate includes:

a collar connected with said tray, and shaped to closely receive said support post therein; and means for releasably connecting said collar with said support post at selected locations therealong.

30. A combination tool caddy and stool as set forth in claim 20, wherein said horizontal mounting means for said plate includes:

a rigid support arm having first and second ends;

means for connecting said plate with the first end of said support arm;

a second collar connected with the second end of said support arm and shaped to closely receive said support post therein to support said plate in a cantilevered fashion from said vertical post;

means for releasably connecting said second collar with said support post at selected locations therealong.

31. A combination tool caddy and stool as set forth in claim 30, wherein:

said means for connecting said plate with said support arm comprises said first-named collar in which said support arm is closely received.

32. A combination tool caddy and stool as set forth in claim 31, wherein:

said base includes a first coupling member attached to the central portion of said base; and said seat pedestal includes a second coupling member attached to the lower end thereof, and shaped to mate with said first coupling member to releasably and selectively connect said seat with said base.

33. A combination tool caddy and stool as set forth in claim 32, including:

an extension post having a lower end thereof shaped to mate with said first coupling member, and an upper end thereof shaped to mate with said second coupling member to facilitate supporting said seat in an elevated position.

34. A combination tool caddy and stool as set forth in claim 33, wherein:

said extension post upper end is telescopingly received in the lower end of said seat pedestal; and including:

means for releasably connecting the lower end of said seat pedestal with the upper end of said extension post to adjust the height of said seat.

35. A combination tool caddy and stool as set forth in claim 34, wherein:

said base includes a third coupling member attached to the marginal portion of said base; and said support post includes a fourth coupling member attached to the lower end thereof, and shaped to mate with said third coupling member to releasably and selectively connect said support post with said base.

36. A combination tool caddy and stool as set forth in claim 35, wherein:

said fourth coupling member also mates with said first coupling member, whereby when said seat is removed from said base, said tray can be supported from the central portion of said base to provide additional stability.

37. A combination tool caddy and stool, comprising:

a base adapted to be supported on a generally horizontal work surface, and having a central portion thereof and a marginal portion thereof disposed outwardly of said central portion;

said base having a first coupling member upstanding from the central portion of said base, and a second coupling member upstanding from the marginal portion of said base in a laterally spaced apart relationship with said first coupling member;

a seat having a normally horizontally oriented surface shaped to support a seated user thereon;

a pedestal including an upper end thereof connected with said seat, and a lower end having a third coupling member thereon shaped to mate with said first coupling member to releasably and selectively support said seat on said base at a predetermined position above said base;

a tray having a normally horizontally oriented upper surface shaped to support articles thereon;

a vertical support post having an upper end thereof connected with said tray, and a lower end having a fourth coupling member thereon shaped to mate with said second coupling member to releasably and selectively support said tray on said base at a predetermined position above said base; and wherein said fourth coupling member also mates with said first coupling member, whereby when said seat is removed from said base, said tray can be supported from the central portion of said base to provide additional stability.

38. A combination tool caddy and stool as set forth in claim 37, including:

a plurality of ground engaging wheels connected with said base and positioned to support said combination tool caddy and stool on the work surface, whereby a user seated on said seat can manually propel said combination tool caddy and stool between various work sites.

39. A combination tool caddy and stool as set forth in claim 38, including:

a rigid support arm having first and second ends;

means for connecting said tray with the first end of said tray support arm;

a collar connected with the second end of said tray support arm and shaped to closely receive said support post therein to support said tray in a cantilevered fashion from said vertical post;

means for releasably connecting said collar with said vertical post at selected locations therealong.

40. A combination tool caddy and stool as set forth in claim 39, wherein:

said support post comprises first and second telescoping members, with means for releasably interconnecting said members to vary the height of said tray.

41. A combination tool caddy and stool as set forth in claim 40, including:

an extension post having a lower end thereof shaped for releasable attachment to the upper end of said support post, and end thereof shaped for close reception in said tray support arm collar to facilitate supporting said tray in an elevated position.

42. A combination tool caddy and stool as set forth in claim 41, wherein:

said means connecting said tray to said tray support arm is releasable, whereby said tray can be bodily detached from said support arm and independently transported to various work sites; and said support arm, being adapted for grasping to form a handle to base between various work sites.

43. A combination tool caddy and stool as set forth in claim 42, wherein:

said extension post lower end is shaped to mate with said first coupling member, and said extension post upper end is shaped to mate with said second coupling member to facilitate supporting said seat in an elevated position.

44. A combination tool caddy and stool as set forth in claim 43, wherein:

said base includes a lip upstanding along a marginal edge of said base to define another tray, adapted to receive articles therein, and disposed normally below said first-named tray.

45. A combination tool caddy and stool as set forth in claim 44, wherein:

said tray arm collar is shaped to mate with said third coupling member to provide a low profile handle for said base.

46. A combination tool caddy and stool as set forth in claim 45, wherein:

said first and third coupling members each comprise a stud upstanding from said base;

said second and fourth coupling members each comprise a socket shaped to closely receive one of said studs therein; and said studs and said sockets have a geometrically similar, non-circular, transverse cross-sectional shape.

47. A combination tool caddy and stool, comprising:

a base adapted to be supported on a generally horizontal work surface, and including a central portion thereof and a marginal portion thereof disposed laterally outwardly of said central portion;

a seat having a normally horizontally oriented upper surface shaped to support a seated user thereon, and a pedestal including an upper end thereof connected with said seat, and a lower end thereof connected with and upstanding from the central portion of said base to support said seat on said base at a predetermined position above said base;

a tray having a normally horizontally oriented upper surface shaped to support aritcles thereon, and a vertical support post having an upper end thereof connected with said tray, and a lower end thereof connected with and upstanding from the marginal portion of said base to support said tray on said base at a predetermined position above said base;

a plurality of ground engaging wheels connected with said base and positioned to support said combination tool caddy and stool on the work surface; said base having a generally trapezoidal plan shape with four corners at each of which one of said wheels is mounted, whereby a user seated on said seat can manually propel said combination tool caddy and stool between various work sites.

48. A combination tool caddy and stool as set forth in claim 47, wherein:

said base includes a lip upstanding along a marginal edge of said base to define another tray, adapted to receive articles therein, and disposed normally below said first-named tray.

* * * * *

UNITED STATES PATENT AND TRADEMARK OFFICE

CERTIFICATE OF CORRECTION

PATENT NO. : 4,632,410

DATED : December 30, 1986

INVENTOR(S) : John F. Bainbridge et al.

It is certified that error appears in the above-identified patent and that said Letters Patent is hereby corrected as shown below:

Column 3, line 60:

Insert --.-- after "inches"

Column 5, line 21:

"arm 5" should be --arm 6--

Column 5, line 34:

"tray 6" should be --tray 5--

Column 6, line 13:

"arm 4" should be --arm 6--

Column 6, line 16:

"arm 3" should be --arm 6--

Column 6, line 23:

"arm 3" should be --arm 6--

Column 7, line 4:

"lock nut" should be --lock bolt--

Column 7, line 23:

"arm 5" should be --arm 6--

UNITED STATES PATENT AND TRADEMARK OFFICE

CERTIFICATE OF CORRECTION

PATENT NO. : 4,632,410

DATED : December 30, 1986

INVENTOR(S) : John F. Bainbridge et al.

It is certified that error appears in the above-identified patent and that said Letters Patent is hereby corrected as shown below:

Column 10, Claim 25, Line 33:

"releasably" should be --releasable--

Column 11, Claim 30, Line 32:

"Claim 20" should be --Claim 29--

Column 13, Claim 40, Line 7:

Before "members" insert --telescoping--

Column 10, Claim 26, Line 43:

Delete lines 43-60

Column 13, Claim 42, Line 19:

Before "connecting" insert --for--

Column 13, Claim 42, Line 21:

Before "support" insert --tray--

UNITED STATES PATENT AND TRADEMARK OFFICE

CERTIFICATE OF CORRECTION

PATENT NO. : 4,632,410

DATED : December 30, 1986

INVENTOR(S) : John F. Bainbridge et al.

It is certified that error appears in the above-identified patent and that said Letters Patent is hereby corrected as shown below:

Column 13, Claim 42, Line 24:

Before "base" insert --move said--

Signed and Sealed this

Twenty-fifth Day of August, 1987

*Attest:*

DONALD J. QUIGG

*Attesting Officer*

*Commissioner of Patents and Trademarks*